US005338028A

United States Patent [19]

Sung

[11] Patent Number: 5,338,028

[45] Date of Patent: Aug. 16, 1994

[54] RACKET STRINGING APPARATUS

[75] Inventor: Lan-Chung Sung, Taichung Hsien, Taiwan

[73] Assignee: Right Way Co., Taichung Hsien, Taiwan

[21] Appl. No.: 174,503

[22] Filed: Dec. 28, 1993

[51] Int. Cl.[5] ..... A63B 51/14

[52] U.S. Cl. ..... 273/73 A

[58] Field of Search ..... 273/73 R, 73 A, 73 B

[56] References Cited

U.S. PATENT DOCUMENTS

| | | | |
|---|---|---|---|
| 3,302,950 | 2/1967 | Hartman | 273/73 A |
| 4,373,721 | 2/1983 | Ray | 273/73 A |
| 4,706,955 | 11/1987 | Ngadi et al. | 273/73 A |
| 4,949,968 | 8/1990 | Korte-Jungermann | 273/73 A |
| 5,090,697 | 2/1992 | Lee | 273/73 A |
| 5,269,515 | 12/1993 | Chu | 273/73 A |

FOREIGN PATENT DOCUMENTS

| | | | |
|---|---|---|---|
| 3326261 | 1/1985 | Fed. Rep. of Germany | 273/73 A |
| 2557464 | 7/1985 | France | 273/73 A |

*Primary Examiner*—William E. Stoll

*Attorney, Agent, or Firm*—Townsend and Townsend Khourie and Crew

[57] ABSTRACT

A racket stringing apparatus includes a frame unit, a racket retaining device and a string tautening device. The string tautening device includes a string clamping unit, a swing lever and a counterweight mounted movably on the swing lever. A stringing receiving groove unit is formed in the top surface of the string clamping unit and has a non-clamping section and a clamping section. The non-clamping section has a fixed width, while the clamping section has a width which can be adjusted to clamp tightly a string therein. The string tautening device includes a limit member which has a first limit peripheral surface and a second limit peripheral surface. The swing lever has a lower end which normally abuts against the first limit peripheral surface so as to prevent the actuator end portion of the swing lever from turning toward the racket retaining device and to permit the actuator end portion to turn away from the racket retaining device until the swing lever contacts the second limit peripheral surface. When the swing lever contacts the second limit peripheral surface, the actuator end portion of the swing lever is located at a level above the bottom surface of the frame unit.

5 Claims, 12 Drawing Sheets

RACKET STRINGING APPARATUS

BACKGROUND OF THE INVENTION

1. Field of the Invention

This invention relates to a racket stringing apparatus whereby rackets, such as tennis rackets, can be strung quickly under an appropriate tension so as to provide a superior playing quality to the rackets.

2. Description of the Related Art

The improvement of this invention is directed to a conventional racket stringing apparatus which is shown in FIG. 1 and which includes a metal base plate 1, a racket retaining device 2, a rectangular casing 3 and a string tautening device 4. As illustrated, the base plate 1 has an outline of a racket and has a fixed upright shaft 10 which has several circumferentially aligned horizontal positioning holes 101 formed in the peripheral surface of the base plate 1.

The racket retaining device 2 includes a support plate 20 having a downward flange 201 which is shaped in the form of a hollow cylinder and which is sleeved on the upper end portion of the shaft 10. The flange 201 has a horizontal positioning hole 202 formed therethrough so that a horizontal positioning pin 203 extends through said positioning hole 202 of the flange 201 into selected one of the positioning holes 101 of the shaft 10. A set of retainer units 21 are disposed on the support plate 20. The distance between the retainer units 21 can be adjusted to retain effectively a racket (not shown) thereon.

The casing 3 is fixed on the base plate 1 and has an open top end and an internal space 30. A notch 31 is formed in the upper end of a wall of the casing 3. As shown in FIG. 2, the string tautening device 4 includes a rotary element 40 mounted rotatably within the casing 3 by a pivot pin 401, an inverted U-shaped hollow lower clamping member 41 riding and pivoted to the rotary element 40, and an upper clamping member 42 mounted movably on the lower clamping member 41 and having two flanges 421, 422 projecting from two opposite sides of the upper clamping member 42. A coiled spring 43 is received in the lower clamping member 41. Two metal washers 44 respectively abut against the upper and lower ends of the spring 43, and are respectively pushed by the spring 43 to the upper and lower ends of the internal space of the lower clamping member 41. An impelling rod 45 has a lower end pivoted to the rotary element 40 by a pivot pin 451, an upper end secured to the upper clamping member 42 by a positioning pin 452, and an intermediate portion extending through the spring 43 and the washers 44. An inclined swing lever 46 is secured in the cylindrical hole 402 of the rotary element 40 by a positioning pin 461 and has a series of marks (see FIG. 1) indicated on the lever 46. A counterweight 47 (see FIG. 1) is mounted movably on the lever 46 so as to adjust the force to tauten the string 5 which is to be strung on the racket (not shown). An elongated blocking member 48 is mounted rotatably in the casing 3 by a pivot pin 481 at the upper portion thereof so that action of gravity locates the blocking member 48 at an inclined normal position, where the upper end of the blocking member 48 presses against the concaved portion 403 of the rotary element 40, with the result that the swing lever 46 cannot be turned downward. A push rod 482 is attached to the blocking member 48 and has an outer end (see FIG. 1) which is exposed to the exterior of the casing 3 and which can be moved to the release position indicated by the phantom lines so as to separate the blocking member 48 from the rotary element 40, thereby enabling the swing lever 46 to be turned downward. Accordingly, the swing lever 46 can be maintained at the inclined normal position unless the push rod 482 is actuated to separate the blocking member 48 from the rotary element 40.

Referring to FIG. 3, in operation, when one desires to string a racket (not shown), the swing lever 46 is turned upward so as to move the impelling rod 45 upward. Upward movement of the impelling rod 45 separates the lower end of the upper clamping member 42 from the upper end of the lower clamping member 42, so as to form a string receiving gap 49 between the upper clamping member 42 and the lower clamping member 41. Referring to FIG. 4, the string 5 is passed through the gap 49 in such a manner that it is pressed against two opposite sides of the impelling rod 45 and of the right flange 421 and extends around the left portion of the left flange 422. Then, referring to FIG. 2, the push rod 482 is moved to the release position indicated by the phantom lines so as to separate the blocking member 48 from the rotary element 40. Subsequently, a hand of the operator holds the portion 52 (see FIG. 4) of the string 5 which extends from the lower side of the right flange 421, while the other hand turns the swing lever 46 downward so as to move the lower end of the upper clamping member 42 toward the upper end of the lower clamping member 41, thus clamping tightly the string 5 between the upper clamping member 42 and the lower clamping member 41 and dividing the string 5 into a tautened section 51 and a non-tautened section 52. At this time, if the swing lever 46 is in a horizontal position, the tension of the tautened section 51 of the string 5 is appropriate. Otherwise, the tautened section 51 of the string 5 is loosened and the above operation procedure is repeated in such a manner that the position of the swing lever 46 is changed until it is in a horizontal position.

The conventional racket stringing apparatus suffers from the following disadvantages:

1. The steps of clamping the string 5 between the upper clamping member 42 and the lower clamping member 41, and of actuating the swing lever 46 and the push rod 482 to adjust the tension to tauten the string 5, are time-consuming.

2. Because the positions of the positioning holes 101 of the shaft 10 cannot be seen by the operator, the step of passing the positioning pin 203 through the positioning hole 202 of the flange 201 and into selected one of the positioning holes 101 of the shaft 10 is time-consuming and troublesome.

3. Because there is no means for preventing the swing lever 46 from moving to a level below the bottom surface of the base plate 1, when the blocking member 48 separates from the rotary element 40 in an undesired condition, the actuator end of the swing lever 46 may strike on the ground, causing damage and reduced-straightness of the swing lever 46. This reduction of the straightness decreases the precision of the apparatus.

4. The apparatus is too bulky to have a convenient transportation and storage.

SUMMARY OF THE INVENTION

An object of this invention is to provide a racket stringing apparatus whereby a racket can be strung quickly under an appropriate tension.

Another object of this invention is to provide a racket stringing apparatus with a limit member which prevents any position of the swing lever of the apparatus from moving to a level below the bottom end of the frame unit of the apparatus so as to avoid the damage to the swing lever.

Still another object of this invention is to provide a racket stringing apparatus with a frame unit which can be adjusted to reduce the space occupied thereby in order for convenience in transportation or storage when the apparatus is not in use.

According to this invention, a racket stringing apparatus includes a frame unit, a racket retaining device and a string tautening device. The string tautening device includes a vertical reference plate unit mounted rotatably on the frame unit, a vertical movable plate unit having a portion mounted movably on the frame unit, and a groove unit formed between the upper ends of the reference plate unit and the movable plate unit and which receives a string in the groove unit. The groove unit has a non-clamping section and a clamping section. The non-clamping section has a fixed width. The movable plate unit can be actuated manually to clamp tightly the string between the reference plate unit and the movable plate unit at the clamping section of the groove unit. A limit member is fixed on the frame unit and has a first limit peripheral surface and a second limit peripheral surface. A swing lever has a pivotal end portion mounted rotatably on the frame unit, and an actuator end portion located above the pivotal end portion. The pivotal end portion of the swing lever abuts against the first limit peripheral surface of the limit member so as to prevent the swing lever from turning toward the racket retaining device and to permit the swing lever to turn away from the racket retaining device until the swing lever abuts against the second limit peripheral surface of the limit member. The actuator end portion of the swing lever is at a level above that of the bottom surface of the frame unit when the swing lever abuts against the second limit peripheral surface of the limit member. When the swing lever is in a horizontal position, the string is tensioned to an appropriate force. A counterweight is mounted movably on the swing lever. In the preferred embodiment, the frame unit includes a longitudinal rod supporting the racket retaining device and the string tautening device thereon, and a transverse rod mounted pivotally on and under the longitudinal rod in such a manner that an angle of about 90 degrees is formed therebetween. When the apparatus is not in use, the transverse rod can be rotated to parallel with the longitudinal rod so as to reduce a space which is occupied by the apparatus.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
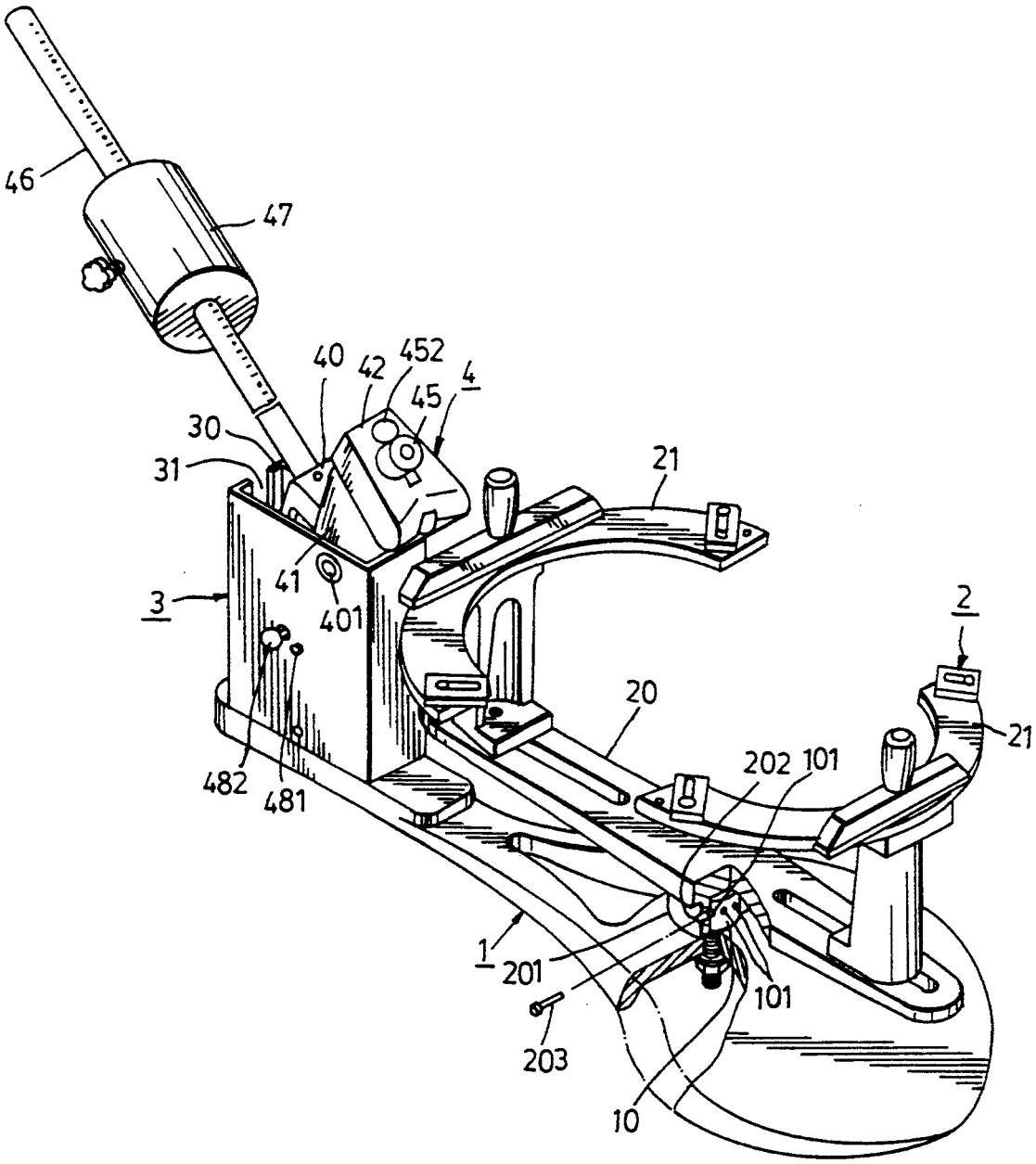
FIG.1 PRIOR ART
FIG. 1 is a perspective view of a conventional racket stringing apparatus.
Figure 2:
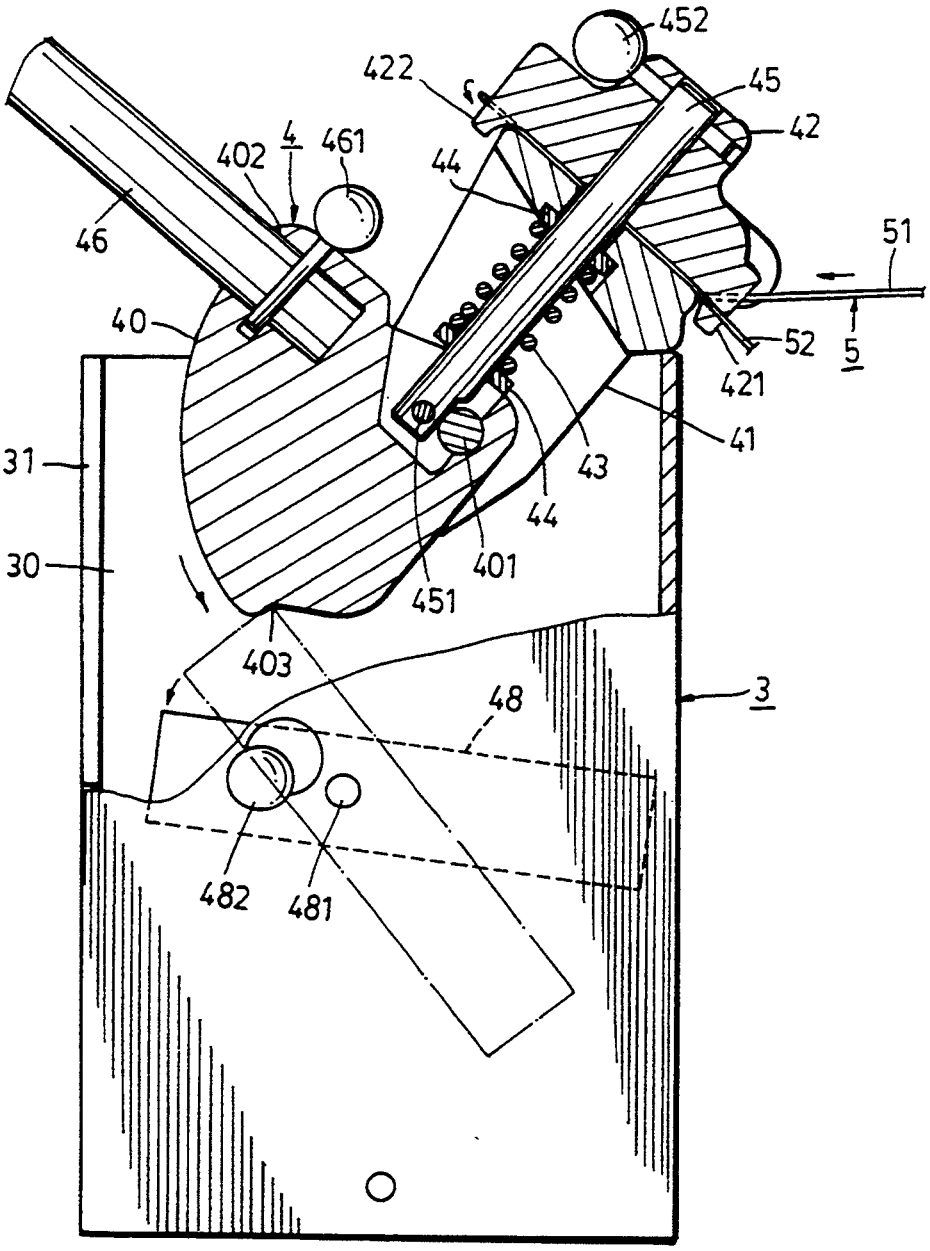
FIG.2 PRIOR ART
FIG. 2 is a schematic view illustrating the string tautening device of the conventional racket stringing apparatus.
Figure 3:
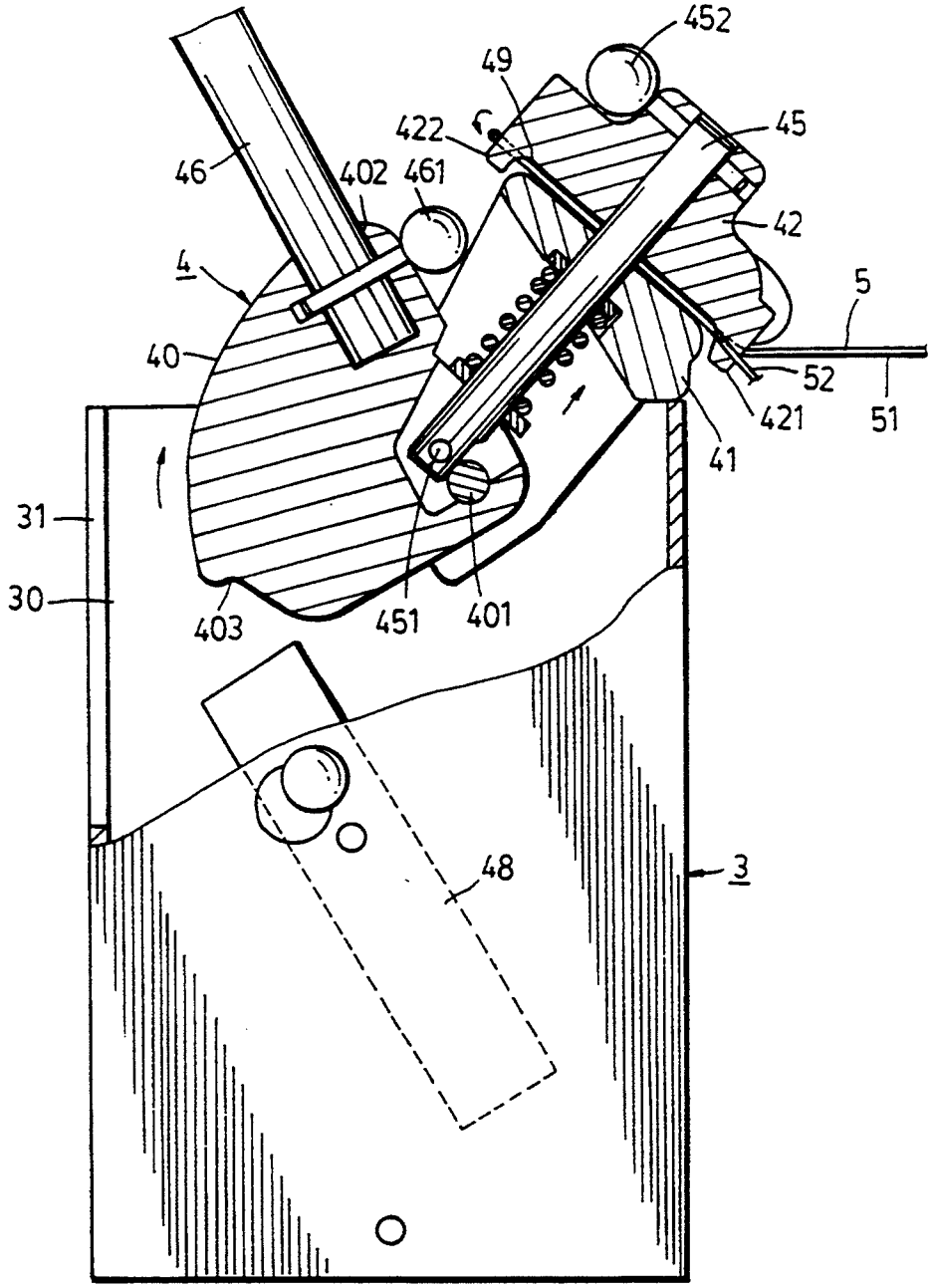
FIG.3 PRIOR ART
FIG. 3 is a schematic view illustrating the operation of the string tautening device of the conventional racket stringing apparatus.
Figure 4:
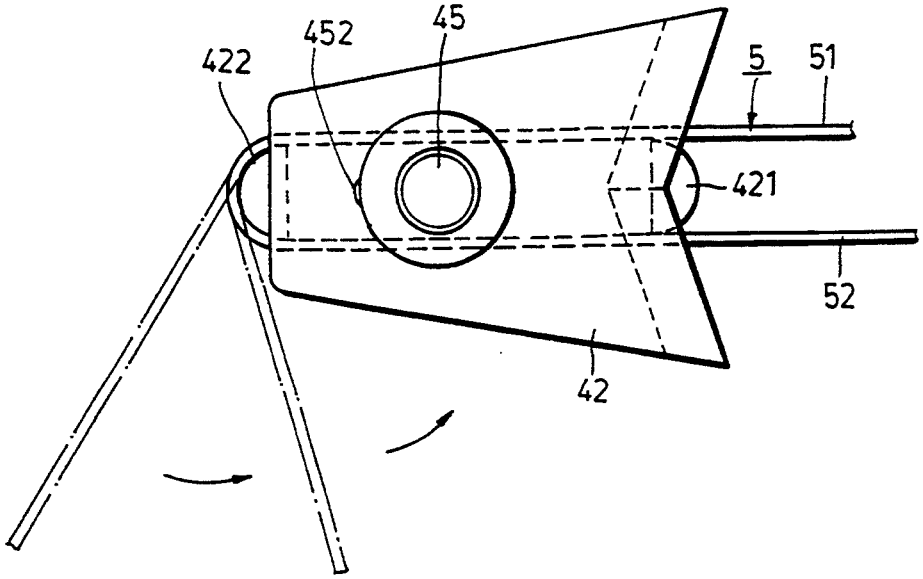
FIG.4 PRIOR ART
FIG. 4 is a schematic view illustrating how a string is put in the stringing clamping device of the conventional racket stringing apparatus.
Figure 5:
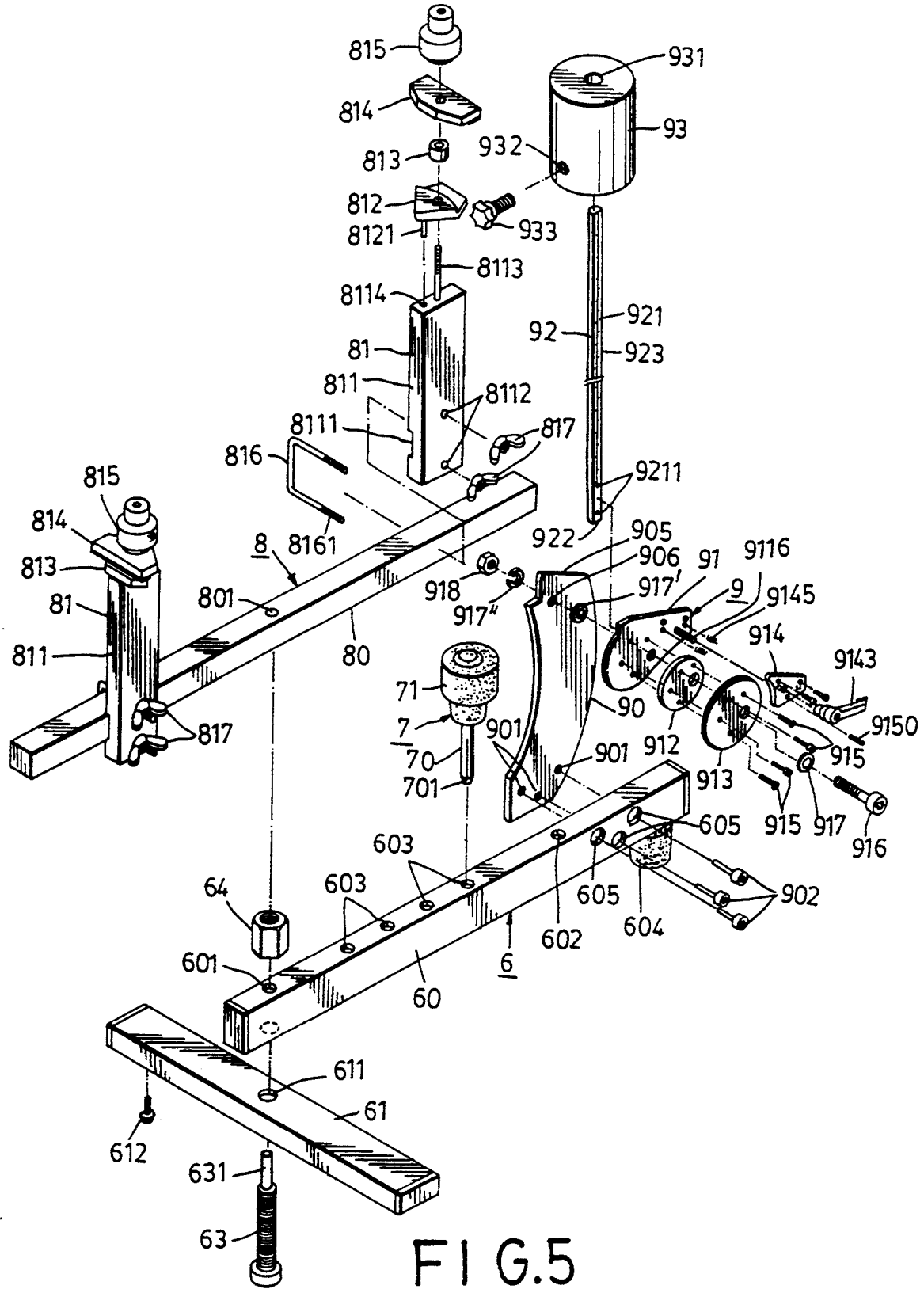
FIG. 5 is an exploded view of a racket stringing apparatus according to this invention.

Referring to FIG. 5, a racket stringing apparatus of this invention includes a frame unit 6, a blocking piece 7, a racket retaining device 8 and a string tautening device 9.

Figure 7:
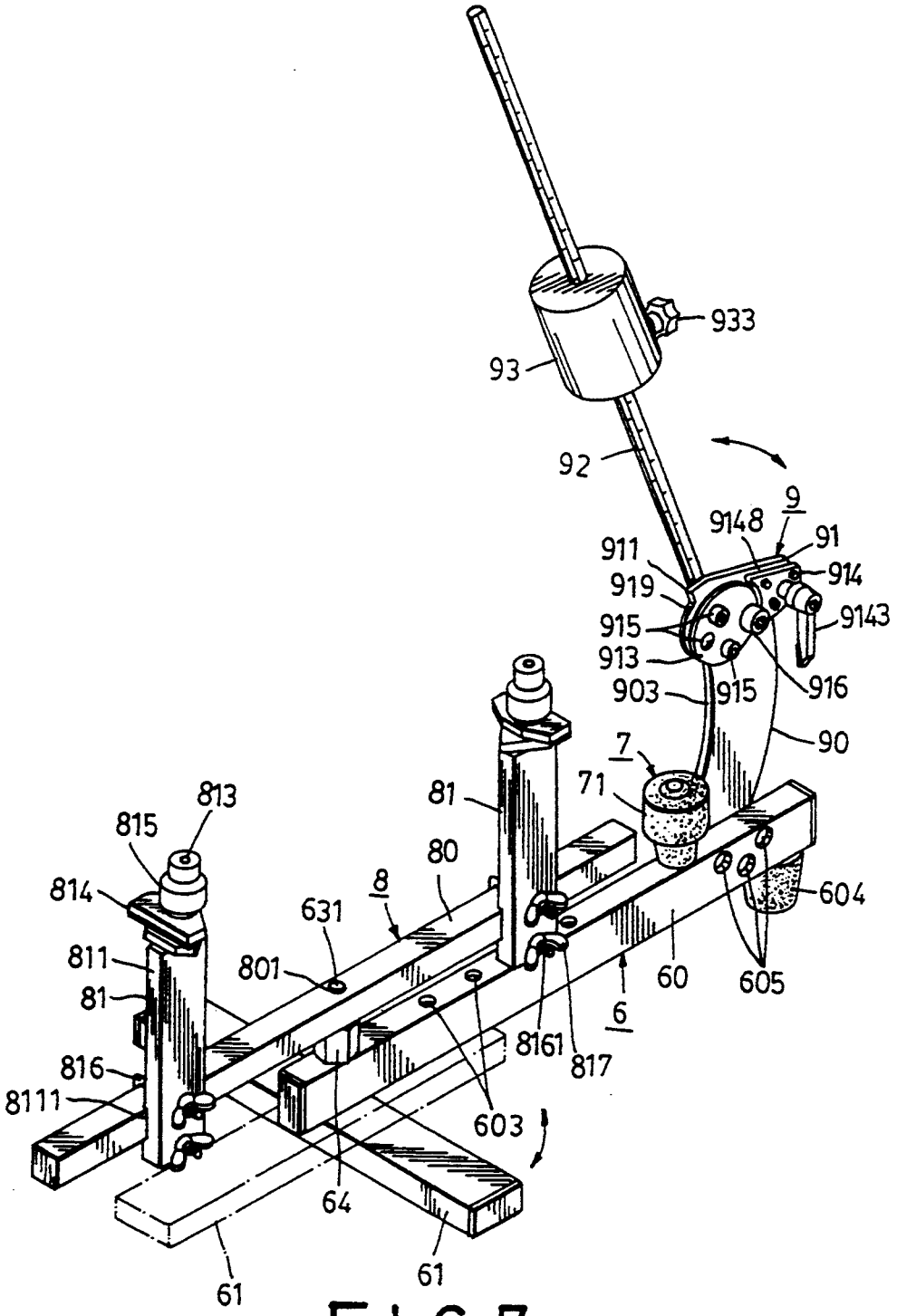
FIG. 7 is a perspective view showing the racket stringing apparatus of this invention.

The frame unit 6 includes a longitudinal rod 60 of a square cross-section, and a transverse rod 61 of a rectangular cross-section perpendicular to the longitudinal rod 60. The longitudinal rod 60 has a vertical pivot hole 601 formed through the left end portion thereof, a vertical attachment hole 602 formed through the right end portion, and four vertical positioning holes 603 formed through the longitudinal rod 60 between the pivot hole 601 and the attachment hole 602. The transverse rod 61 has a pivot hole 611 so that the threaded portion of a pivot rod 63 extends through the pivot holes 601, 611 of the longitudinal rod 60 and the transverse rod 61 to engage with a lock nut 64. Accordingly, the transverse rod 61 is mounted rotatably on the left end portion of the longitudinal rod 60. Referring to FIG. 7, the transverse rod 61 can be rotated to parallel with the longitudinal rod 60 for purposes of convenient transportation and storage. A rubber cushion 612 is screwed to the underside of the transverse rod 61 so as to prevent the transverse rod 61 from sliding movement on the ground when the apparatus is in use. Similarly, a rubber support element 604 is secured to the bottom surface of the right end portion of the longitudinal rod 60. The longitudinal rod 60 further has three horizontal circular holes 605 formed through the right end portion thereof which are arranged in a triangle.

The blocking piece 7 has a metal section 70 disposed at the lower portion thereof, and a rubber section 71 secured to the upper end of the metal section 70. The metal section 70 has a truncated conical lower end 701 so as to be easily inserted into the attachment hole 602 when the apparatus is not in use. In use, the blocking piece 7 is moved to selected one of the positioning holes 603.

The racket retaining device 8 includes a guide rod 80 and two retainer units 81 respectively disposed on two end portions of the guide rod 80. The guide rod 80 has a vertical middle hole 801 through which the reduceddiameter upper end portion 631 of the pivot rod 63 extends. Each of the retainer units 81 includes a sliding body 811, a plastic lower retainer sheet 812, a collar 813, a metal upper retainer sheet 814, a lock nut 815 and a U-shaped fastener rod 816.

Each of the sliding bodies 811 has an open-ended horizontal slide slot 8111 formed in a side wall thereof, two fastener holes 8112 formed through the sliding body 811 on two sides of the slide slot 8111 so that two threaded end portions 8161 of the corresponding U-shaped fastener rod 816 extend through the fastener holes 8112 to engage with two butterfly nuts 817 respectively, and a vertical connecting rod 8113 which is fixed on the top surface of the sliding body 81, and which extends through the corresponding lower retainer sheet 812, the corresponding collar 813 and the corresponding upper retainer sheet 814 to engage threadably with the corresponding lock nut 815. Each of the lower retainer sheets 812 includes a stepped top surface and a vertical positioning pin 8121 which is connected securely to the bottom surface of the lower retainer sheet 812 and which extends into the positioning hole 8114 of the corresponding sliding body 811. Each of the upper retainer sheets 814 has a stepped bottom surface in alignment with the stepped top surface of the corresponding lower retainer sheet 812 so as to clamp tightly the racket between the upper retainer sheet 814 and the lower retainer sheet 812.

Figure 6:
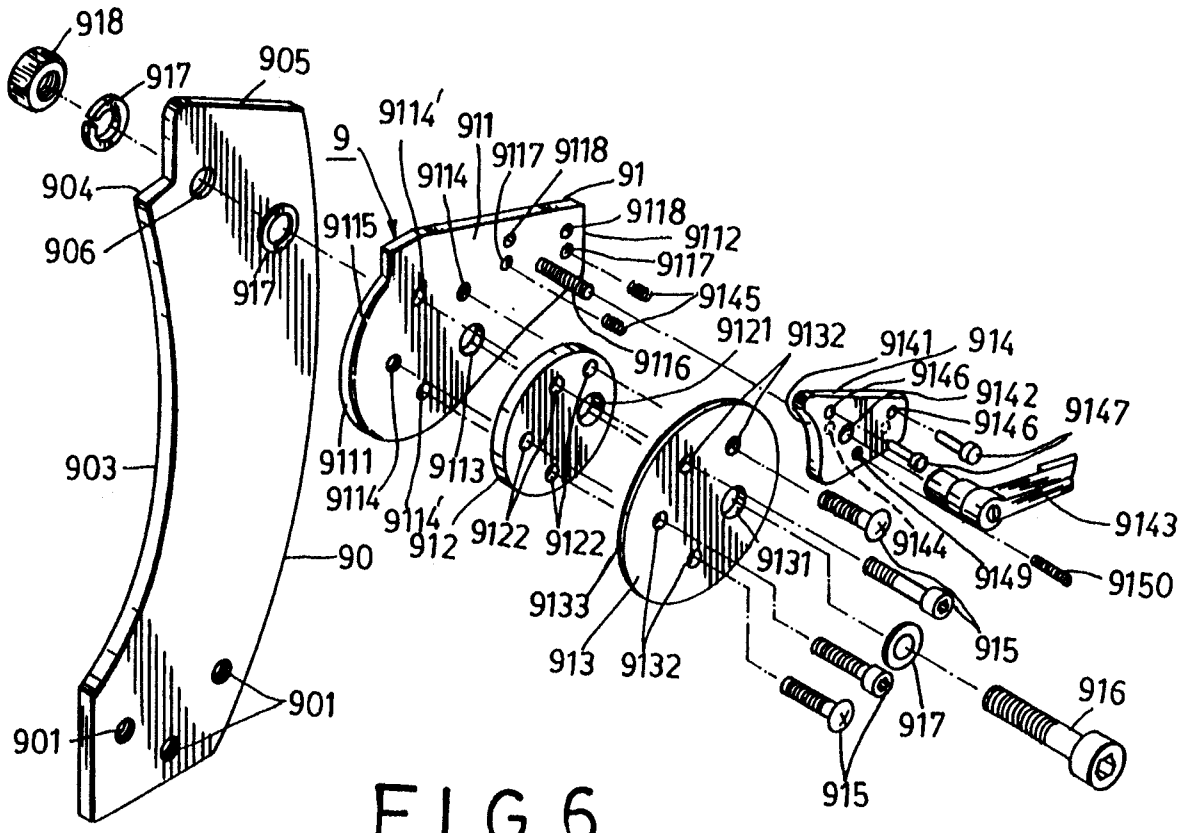
FIG. 6 is an exploded view showing the string tautening device of the racket stringing apparatus according to this invention.

As best shown in FIG. 6, the string tautening device 9 includes a plate-shaped limit member 90, a swing lever 90, a string clamping unit 91, a swing lever 92 and a counterweight 93 which is mounted movably on the swing lever 92 in a known manner. The swing lever 92 has a scale surface 921, a lower pivotal end portion mounted rotatably on the frame unit 6, and an upper actuator end portion.

Again referring to FIG. 5, the limit member 90 is made of metal and has three threaded holes 901 formed therethrough in alignment with the circular holes 605 of the longitudinal rod 60 of the frame unit 6. Three threaded rods 902 respectively extend through the circular holes 605 of the frame unit 6 to engage with the threaded holes 901 of the limit frame 90 so as to fix the limit member 90 on the frame unit 6.

As shown in FIG. 6, the limit member 90 has a concaved surface 903 facing toward the racket retaining device 8, a generally V-shaped first limit peripheral surface 904 located at the upper end portion of the limit member 90, an inclined top surface or second limit peripheral surface 905, and a threaded hole 906 formed through the limit member 90 near the first limit peripheral surface 904.

The string clamping unit 91 includes a reference plate unit 911, a small circular plate 912, and a movable plate unit consisting of a large circular plate 913 and a clamping plate 914.

The reference plate unit 911 has a curved peripheral surface 9111 on the left side thereof, a vertical peripheral surface 9112 on the right side of the reference plate unit 911, and a pivot hole 9113 formed through the middle portion of the reference plate unit 911. Two threaded holes 9114 and two fastening holes 9114' are formed through the reference plate unit 911 near the pivot hole 9113. Correspondingly, the small circular plate 912 has a pivot hole 9121 and four fastening holes 9122. The large large circular plate 913 has a pivot hole 9131 and four fastening holes 9132. Four lock bolts 915 respectively extend through the fastening holes 9132, 9122 of the large and small circular plates 913, 912. Two of the lock bolts 915 respectively engage with the threaded holes 9114 of the reference plate unit 911. Another two of the lock bolts 915 continue to extend through the fastening holes 9114' of the reference plate unit 911 to engage with the threaded holes 9211 of the lower end portion of the swing lever 92. All of the reference plate unit 911, the small circular plate 912 and the large circular plate 913 can rotate synchronously with the swing lever 92. The large circular plate 913 is coaxial with the small circular plate 912. A large pivot pin 916 extends through a right washer 917, the pivot holes 9131, 9121, 9111 of the large circular plate 913, the small circular plate 912 and the reference plate unit 911, and the left washer 917', to engage with the threaded hole 906 of the limit member 90. A retaining ring 917'' is sleeved on the left end portion of the large pivot pin 916 and abuts against the limit member 90. A lock nut 918 is engaged with the threaded left end of the large pivot pin 916 and abuts against the retaining ring 917''. As a result, The assembly of the reference plate unit 911, the small circular plate 912, the large circular plate 913 and the swing lever 92 is mounted rotatably on the limit member 90.

The reference plate unit 911 further includes an inclined inward peripheral surface 9115 (see FIG. 10), a threaded horizontal rod 9116 connected securely to the inward surface of the unit 911, two cavities 9117 formed in the inward surface of the unit 911 near the vertical peripheral surface 9112, and two positioning holes 9118 formed in the inward surface of the unit 911 above the cavities 9117.

Figure 9:
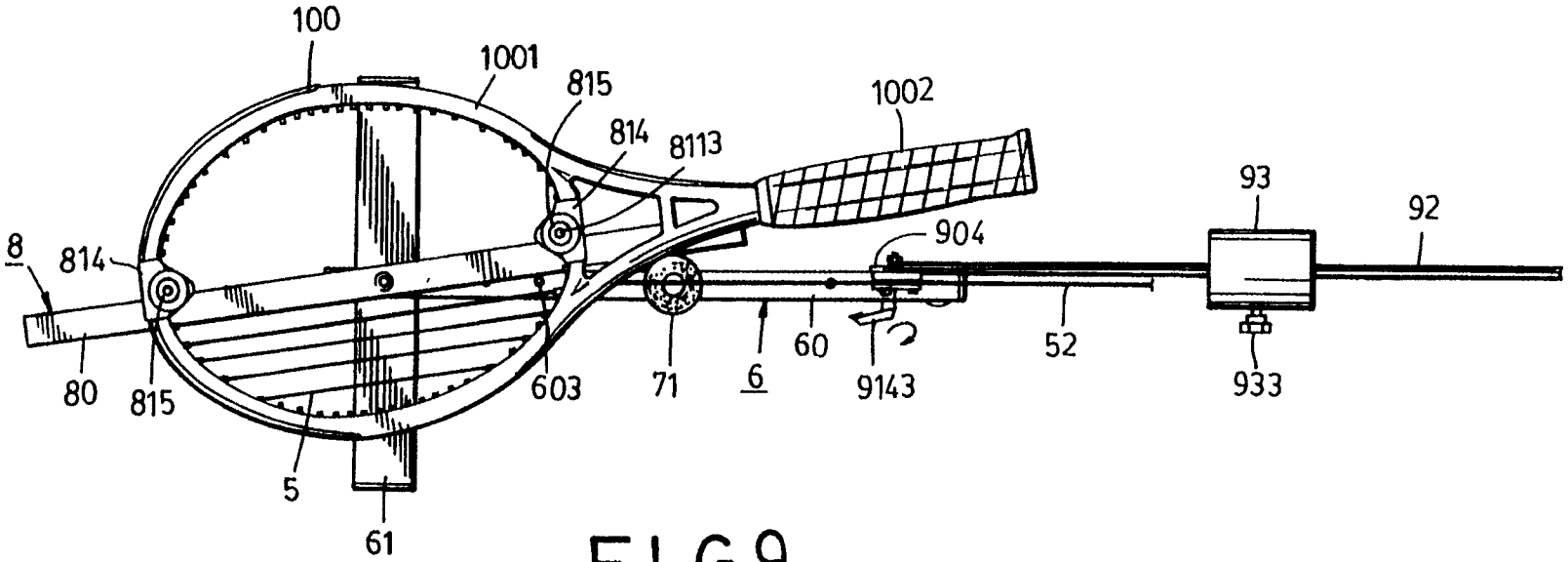
FIG. 9 is a schematic view illustrating the position of a blocking piece relative to a racket which is retained on the racket stringing apparatus of this invention.
Figure 10:
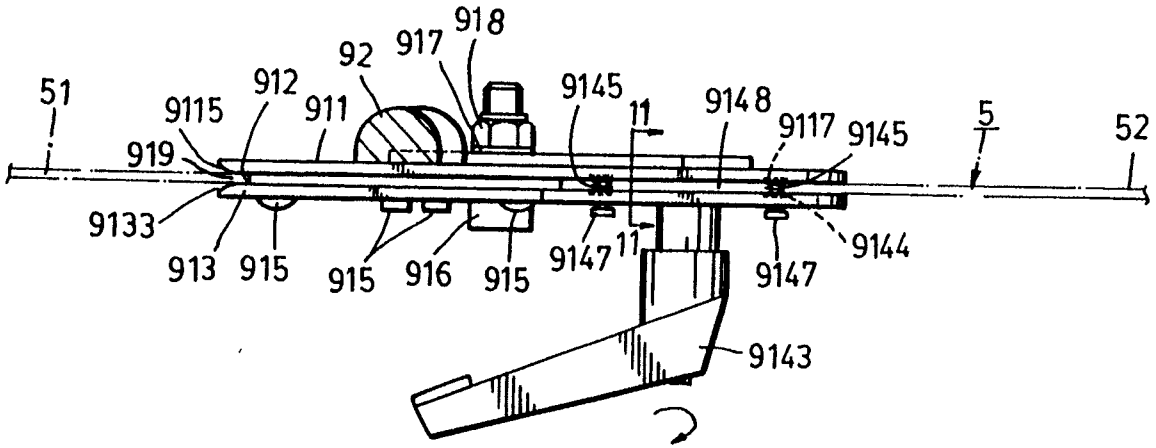
FIG. 10 is a schematic top view illustrating the string tautening device of the racket stringing apparatus according to this invention.

As best shown in FIGS. 6 and 10, the clamping plate 914 has a concaved peripheral surface 9141 abutting against the large circular plate 913, a rod hole 9142 formed through the clamping plate 914 so that the internally threaded shaft of a generally L-shaped control element 9143 extends therethrough to engage threadably with the threaded horizontal rod 9116, and two cavities 9144 formed in the inward surface of the clamping plate 914 in alignment with the cavities 9117 of the reference plate unit 911 so as to confine the ends of two coiled springs 9145 therein. Two positioning pins 9147 respectively extend through the positioning holes 9146 of the clamping plate 914 and into the positioning holes 9118 of the reference plate unit 911 so as to prevent rotation of the clamping plate 914 relative to the reference plate unit 911. A string receiving groove unit 9148 (see FIGS. 7 and 10) is formed between the reference plate unit 911 and the movable plate unit 913 and 914, and has a non-clamping section defined between the reference plate unit 911 and the large circular plate 913, and a clamping section defined between the reference plate unit 911 and the clamping plate 914. It is appreciated that the string receiving groove unit 9148 is disposed in the top surface of the string clamping unit 91 so as to offer a timesaving string clamping process to the apparatus. A threaded hole 9149 is formed through the lower portion of the clamping plate 914. An adjustment bolt 9150 is engaged threadably with the threaded hole 9149 of the clamping plate 914 and is adjusted so that an end of the adjustment bolt 9150 is spaced apart from the inward surface of the clamping plate 914 at a distance which is slightly smaller than the diameter of the string 5 to be strung on the racket 100 (see FIG. 9). The rotary arm of the control element 1943 can be rotated so that the shoulder of the shaft of the control element 1943 impels the clamping plate 914 toward the reference plate unit 911 until the adjustment bolt 9150 contacts the reference plate unit 911, thus clamping tightly the string 5 between the reference plate unit 911 and the clamping plate 914. At this time, as shown in FIG. 10, the string 5 is divided into a tautened section 51 and a non-tautened section 52.

Figure 8:
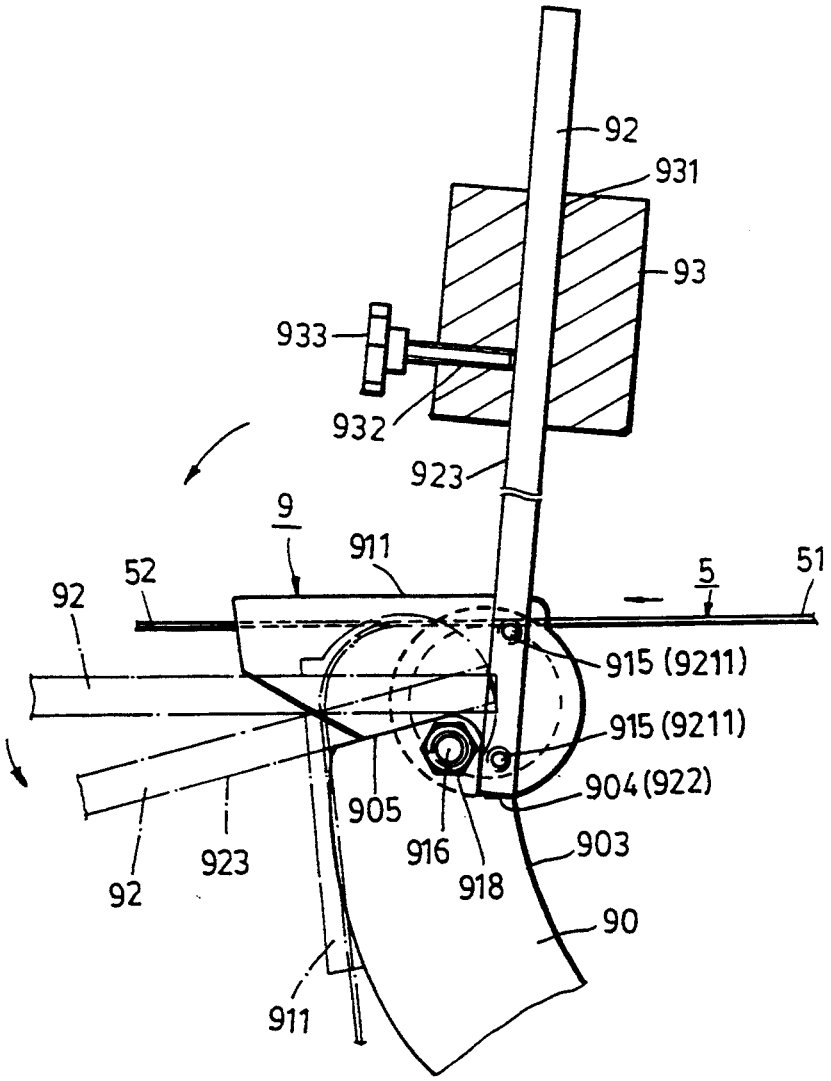
FIG. 8 is a schematic view illustrating how a limit member limits the swing lever of the racket stringing apparatus to rotate between two positions in accordance with this invention.

As best shown in FIGS. 8 and 10, the swing lever 92 has a lower end portion 922 which normally abuts against the first limit peripheral surface 904 of the limit member 90 so as to prevent the upper actuator end portion 923 from turning toward the racket retaining device 8 and to permit the upper actuator end portion 923 to turn away from the racket retaining device 8 until the upper actuator end portion 923 is turned to the position indicated by the phantom lines in FIG. 8, where it abuts against the second limit peripheral surface 905 of the limit member 90. As illustrated, when the swing lever 92 abuts against the second limit peripheral surface 905, the actuator end portion 923 of the swing lever 92 is located at a level above the bottom surface of the frame unit 6 and cannot contact the ground. The counterweight 93 has a central bore 931 through which the swing lever 92 extends, and a threaded hole 932 through which a lock bolt 933 extends to press against the swing lever 92 so as to lock the counterweight 93 on the swing lever 92. When the swing lever 92 is in a horizontal position, the string 5 is tensioned to an appropriate force so as to provide a superior playing quality to the racket.

Referring to FIG. 7, the blocking piece 7 is normally inserted into the attachment hole 602 of the longitudinal rod 60. Referring to FIG. 9, in use, the blocking piece 7 is moved to selected one of the positioning holes 603 of the longitudinal rod 60 according to the positions of the frame portion 1001 and the throat portion of the racket 100 so that the rubber section 71 of the blocking piece 7 is located between the actuator end portion 923 of the swing lever 92 and the frame portion 1001 of the racket 100, thereby preventing the swing lever 92 from contacting the racket frame portion 923.

Figure 11:
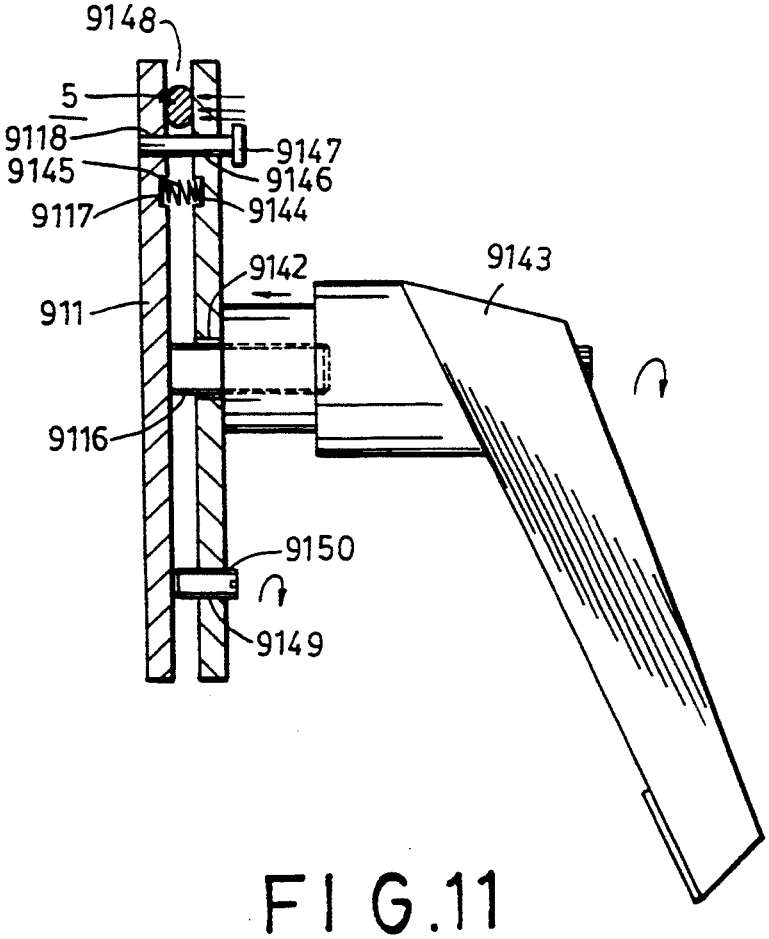
FIGS. 11 and 12 illustrate how the adjustment bolt of the racket stringing apparatus is operated in accordance with this invention.

When the diameter of the string is increased, the adjustment bolt 9150 is rotated in the direction shown in FIG. 11 so as to increase the smallest permissible distance between the reference plate unit 911 and the clamping plate 914.

Figure 12:
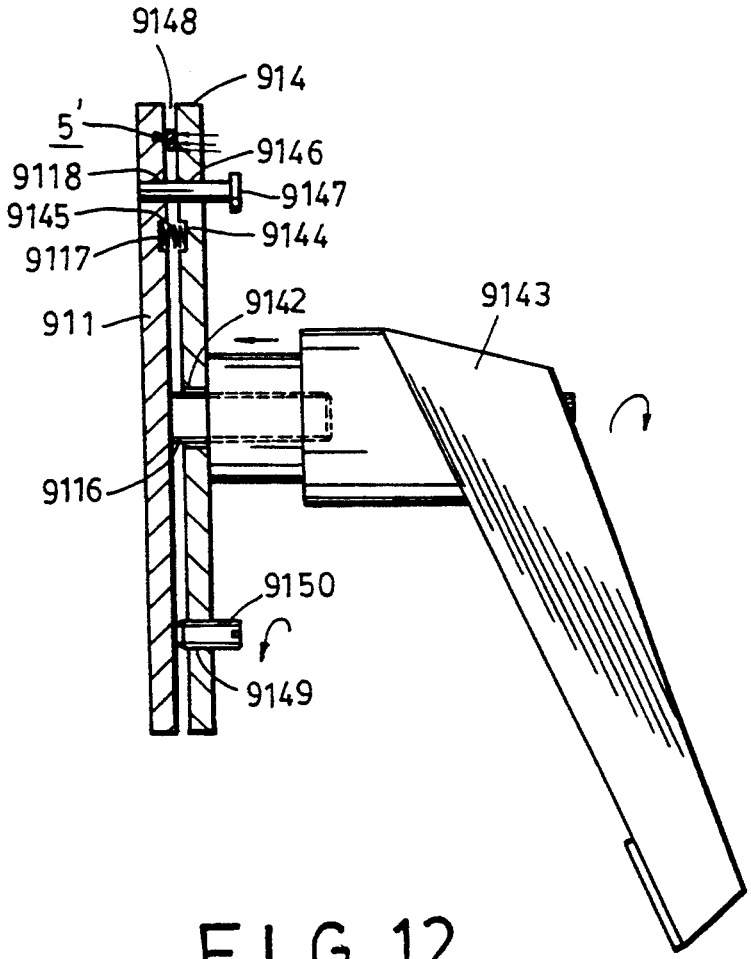

Referring to FIG. 12, when it is desired to secure a thinner string 5' on another racket (not shown), the adjustment bolt 9150 is rotated in the opposite direction so as to reduce the smallest permissible distance between the reference plate unit 911 and the clamping plate 914.

With this invention thus explained, it is apparent that numerous modifications and variations can be made without departing from the scope and spirit of this invention. It is therefore intended that this invention be limited only as indicated in the appended claims.

I claim:

1. A racket stringing apparatus comprising:

a frame unit;

a racket retaining device disposed on said frame unit and adapted to retain a racket on said frame unit; and a string tautening device including a vertical reference plate unit mounted rotatably on said frame unit, a vertical movable plate unit having a portion mounted movably on said frame unit, and a groove unit which is formed between upper ends of said reference plate unit and said movable plate unit and which is adapted to receive a string in said groove unit, said groove unit having a non-clamping section and a clamping section, said non-clamping section having a fixed width, said movable plate unit being capable of being actuated manually to clamp tightly the string between said reference plate unit and said movable plate unit at the clamping section of said groove unit, said string tautening device further including a limit member fixed on said frame unit and having a first limit peripheral surface and a second limit peripheral surface, a swing lever having a pivotal end portion mounted rotatably on said frame unit and an actuator end portion located above the pivotal end portion, and a counterweight mounted movably on said swing lever, the pivotal end portion of said swing lever abutting against the first limit peripheral surface of said limit member so as to prevent said swing lever from turning toward said racket retaining device and to permit said swing lever to turn away from said racket retaining device until said swing lever abuts against the second limit peripheral surface of said limit member, the actuator end portion of said swing lever being at a level above that of a bottom surface of said frame unit when said swing lever abuts against the second limit peripheral surface of said limit member, the string being tensioned to a predetermined force when said swing lever is in a horizontal position.

2. A racket stringing apparatus as claimed in claim 1, further comprising means for preventing said swing lever from contacting the racket and said racket retaining device when stringing the racket.

3. A racket stringing apparatus as claimed in claim 2, wherein means for preventing said swing lever from contacting the racket and said racket retaining device when stringing the racket includes:

said frame unit having a row of positioning holes formed in an upper surface thereof; and a blocking piece having a metal section mounted removably on said frame unit, and a rubber section connected securely to an upper end of said metal section, said metal section being capable of being moved to selected one of said row of said positioning holes of said frame unit, when stringing the racket, so as to locate said rubber section of said blocking piece between said swing lever and said racket and between said swing lever and said racket retaining device.

4. A racket stringing apparatus as claimed in claim 1, wherein said reference plate unit is mounted pivotally on said limit member and includes a threaded horizontal rod secured thereto in such a manner that an angle of about 90 degrees is formed therebetween, said movable plate unit including a large circular plate mounted securely on said reference plate unit, a clamping plate mounted movably on said reference plate unit, and having a rod hole and a threaded hole which are formed therethrough so that said threaded horizontal rod of said reference plate unit extends through said rod hole, an adjustment bolt engaged threadably with said threaded horizontal hole of said clamping plate and having an end which extends from said threaded horizontal hole and that is spaced apart from said reference plate unit, and a control element which includes a shaft with an externally threaded end engaged threadably with said threaded rod of said reference plate unit, and a rotary arm having an end secured to said shaft, said string tautening device further including a small circular plate connected rotatably to said limit member and secured between said reference plate unit and said large circular plate so as to define the non-clamping section of said groove unit between said reference plate unit and said large circular plate, a top surface of said small circular plate defining a bottom wall of said groove unit, said small and large circular plates being coaxial with each other and being connected to said reference plate unit and to said swing lever in such a manner that said small and large circular plates can rotate synchronously with said reference plate unit and with said swing lever, said shaft of said control element having a shoulder abutting against a wall of said clamping plate, said rotary arm being capable of being rotated about said shaft so as to impel said clamping plate toward said reference plate unit until the end of said adjustment bolt contacts said reference plate unit, thereby adjusting position of said clamping plate relative to said reference plate unit, and clamping tightly the string between said reference plate unit and said clamping plate.

5. A racket stringing apparatus as claimed in claim 1, wherein said frame unit includes a longitudinal rod supporting said racket retaining device and said string tautening device thereon, and a transverse rod mounted pivotally on and under said longitudinal rod in such a manner that an angle of about 90 degrees is formed therebetween, whereby, when said apparatus is not in use, said transverse rod can be rotated to parallel with said longitudinal rod so as to reduce a space which is occupied by said apparatus.

* * * * *